US007204892B2

(12) United States Patent
Ishii et al.

(10) Patent No.: US 7,204,892 B2
(45) Date of Patent: Apr. 17, 2007

(54) HOOP FOR CVT BELT AND MANUFACTURING METHOD THEREFOR

(75) Inventors: Kazuo Ishii, Wako (JP); Yoshihiro Odagiri, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 145 days.

(21) Appl. No.: 10/214,314

(22) Filed: Aug. 8, 2002

(65) Prior Publication Data

US 2003/0045387 A1 Mar. 6, 2003

(30) Foreign Application Priority Data

Aug. 8, 2001 (JP) ..... 2001-240432

(51) Int. Cl.
*C23C 8/26* (2006.01)
*F16G 5/00* (2006.01)

(52) U.S. Cl. ..... 148/318; 148/230; 474/201

(58) Field of Classification Search ..... 148/230, 148/318, 559, 200, 206; 451/34, 132
See application file for complete search history.

(56) References Cited

U.S. PATENT DOCUMENTS 5,531,634 A 7/1996 Schott
6,309,474 B1 * 10/2001 Yagasaki ..... 148/230
6,869,376 B2 * 3/2005 Pennings et al. ..... 474/270
2001/0000912 A1 5/2001 Kambe et al.

FOREIGN PATENT DOCUMENTS

| | | |
|---|---|---|
| GB | 2 205 060 A | 11/1988 |
| JP | 62-080322 | 4/1987 |
| JP | 63-096258 | 4/1988 |
| JP | 63-267157 A | 11/1988 |
| JP | 1-142022 | 6/1989 |
| JP | 03-149176 A | 6/1991 |
| JP | 11-293407 | 10/1999 |
| JP | 2000-063998 | 2/2000 |
| JP | 2001-064755 | 3/2001 |

* cited by examiner

*Primary Examiner*—Roy King
*Assistant Examiner*—Kathleen McNelis
(74) *Attorney, Agent, or Firm*—Arent Fox LLP

(57) ABSTRACT

A hoop for a CVT belt including foreign matter existing in a nitrided hardened layer and surface of the hoop, the foreign matter comprises at least one of an oxide-type foreign matter, a nitride-type foreign matter, and a carbide-type foreign matter. The oxide-type foreign matter has a particle size of 25 μm or less, the nitride-type foreign matter and/or the carbide-type foreign matter have particle sizes of 17 μm or less.

5 Claims, 7 Drawing Sheets

Inclusion($Al_2O_3$, diameter8 $\mu$m)

Inclusion($SiO_2$, diameter10 $\mu$m)

Inclusion(Ti(C,N), one side5 $\mu$m)

HOOP FOR CVT BELT AND MANUFACTURING METHOD THEREFOR

BACKGROUND OF THE INVENTION

1. Field of the Invention

The present invention relates to a hoop for a CVT (continuously variable transmission) belt for an automobile, and more particularly, relates to a technique for enhancing the fatigue strength by minimizing the effects of foreign matter.

2. Description of the Related Art

A CVT belt is composed of plural push blocks linked annularly by a metal hoop. The hoop is exposed to repeated bending loads, and high fatigue strength is therefore required. As a technique for enhancing the fatigue strength of the hoop, various methods have been proposed. For example, (1) Japanese Patent Application Laid-open (JP-A) No. 11-293407 discloses maraging steel in which particle sizes of Ti type inclusions are restricted to 8 μm or less as a hoop material, and (2) JP-A No. 2001-64755 discloses maraging steel in which particle sizes of nonmetallic inclusions are restricted to 30 μm or less. Aside from such improvements in materials, improvements to the hoop itself have also been proposed for example, (3) JP-A No. 62-80322 discloses a technique for removing edges from hoop margins by barrel polishing the hoop, and (4) JP-A No. 1-142022 discloses a technique for enhancing the fatigue strength by gas nitriding treatment of the hoop. Furthermore, (5) JP-A No. 63-96258 discloses a technique for enhancing the fatigue strength by shot peening on the hoop.

To enhance the fatigue strength of the hoop remarkably, it may be considered to combine the means for improving the material and the means for improving the hoop itself in the conventional arts. However, expected effects are not obtained in practice. For example, when the hoop is made of the material disclosed in (1) JP-A No. 11-293407, and it is treated by shot peening disclosed in (5) JP-A No. 63-96258, or by barrel polishing disclosed in (3) JP-A No. 62-80322 to remove edges instead of (or in addition to) shot peening, the fatigue strength is not enhanced remarkably. The reason is that shot or the like is driven into or dents the hoop surface by shot peening. Therefore, even if materials with small inclusions as disclosed in (1) JP-A No. 11-293407 or (2) JP-A No. 2001-64755 are used, foreign matter infiltrates into the surface in the process of manufacturing a hoop product, and such foreign matter may be an initiation of fatigue rupture, thereby lowering the fatigue strength.

As a means for avoiding such phenomena, it is generally known to remove exogenous foreign matter by electrolytic polishing to remove the surface layer of the hoop after barrel polishing or shot peening. By such means, however, the time and labor for manufacture are increased, and the fatigue strength is reduced if the portion provided with residual compressive stress by shot peening is removed.

SUMMARY OF THE INVENTION

It is hence an object of the invention to provide a hoop for a CVT belt which is capable of enhancing the fatigue strength by minimizing the effects of foreign matter without removing the surface layer having a residual stress, and to provide a method of manufacturing the same.

Types of nitriding include salt bath nitriding, gas nitriding, and ion nitriding. Salt bath nitriding is not suited to the purpose of enhancing the fatigue strength because a nitride layer or a porous layer is formed, and ion nitriding is poor in productivity. On the other hand, gas nitriding is free from such problems, and in particular gas nitriding by using ammonia gas is suited to industrial production in applications where the flexural rate is large and high fatigue strength is required, such as for the metal hoop used in automotive CVTs. However, in the gas nitriding process, $N_2$ and $H_2$ are produced by dissociation equilibrium of ammonia, and hydrogen interstitially enters into the steel along with progress in nitriding. Also, in annealing or pickling performed in a reducing atmosphere by hydrogen gas, hydrogen interstitially enters into the steel.

The hydrogen interstitially entering into the steel is captured on the interface of the foreign matter and the matrix of the steel if foreign matter is present in the steel or on the steel surface. The hydrogen thus captured on the surface of the foreign matter in the manufacturing process induces hydrogen brittleness in the course of use of the product, and along with the notching effect by the foreign matter, it initiates fatigue rupture. In particular, brittleness is significant if foreign matter is present on the surface or in the vicinity of the product of which the surface is treated for hardening such as by nitriding, thereby contrarily lowering the fatigue strength.

The amount of hydrogen captured between the matrix of the steel and the foreign mater depends on the surface area of the foreign matter. As the surface area of the foreign matter is increases, a larger amount of hydrogen is captured, and it is likely to act as initiations of fatigue rupture. In addition, the hoop is exposed to repeated bending loads, and the greatest stress acts on the surface and its vicinity. Therefore, the hoop is not sensitive to hydrogen capturing in the inside, but is extremely sensitive to hydrogen capturing near the surface. In the nitrided hoop, therefore, the fatigue strength in the hardened layer by nitriding is extremely important, and when hydrogen is captured on the surface or hardened layer, it has a large effect on the fatigue strength. From such viewpoint, the present inventors quantitatively analyzed the effects of the foreign matter existing in the surface and nitrided hardened layer on the fatigue strength.

The hoop for a CVT belt (hereinafter called a hoop) of the invention is developed on the basis of the above findings. The present invention provides a hoop for a CVT belt, comprising foreign matter existing in a nitrided hardened layer and a surface thereof, wherein the foreign matter has a particle size of 25 μm or less. Herein, the particle size d of foreign matter is expressed by the square root of (dx×dy), that is, $(dx \times dy)^{0.5}$, where dx is the maximum diameter across the foreign matter, and dy is the maximum diameter in the direction perpendicular to the direction of the maximum diameter across the foreign matter, as shown in FIG. 4. The foreign matter includes, aside from the inclusions precipitating in the manufacturing process of the hoop material, driven and dented matter in the hoop in the process of barrel polishing or shot peening. The hoop of the invention may be manufactured by barrel polishing and/or shot peening, and subsequent nitriding.

In the hoop having such a configuration, the fatigue strength can be enhanced without removing foreign matter by electrolytic polishing or the like. That is, by limiting the particle size of foreign matter in the specified range, the hydrogen capturing amount is suppressed, and improvement of in fatigue strength by nitriding is not impeded. It is known that the hydrogen capturing amount differs with the kind of foreign matter. For example, TiN and other nitrides, and SiC and other carbides have a large hydrogen capturing ability, whereas oxides such as $Al_2O_3$, $SiO_2$, and $ZrO_2$ have relatively small hydrogen capturing ability. Therefore, foreign matter of nitrides or carbides, if smaller in particle size, is likely to cause fatigue rupture, whereas foreign matter of oxide is less likely to initiate fatigue rupture if relatively large in particle size.

Other hoops of the invention are defined by confirming these theoretical estimates quantitatively. That is, the present invention further provides a hoop in which the foreign matter existing in the nitrided hardened layer and surface of the hoop comprises at least one of an oxide-type foreign matter, a nitride-type foreign matter, and a carbide-type foreign matter, the oxide-type foreign matter has a particle size of 25 μm or less, the nitride-type foreign matter and the carbide-type foreign matter have particle sizes of 17 μm or less.

The manufacturing method for a hoop of the invention is explained. The present inventors took notice of the foreign matter driven or dented into the hoop by barrel polishing, and researched the abrasive grains used in barrel polishing. In barrel polishing, various abrasive materials are used, such as media having abrasive grains solidified by binder, or compounds containing abrasive grains. When the particle size of these abrasives grains is smaller, the effect is smaller on the fatigue strength when driven into the hoop, but it takes a long time to perform barrel polishing.

Accordingly, the inventors searched for the proper particle size of abrasive grains of abrasive material not having an effect on the fatigue strength if driven into the hoop, while shortening the time required for barrel polishing as much as possible. That is, in the course of barrel polishing, abrasive grains of the abrasive material are ground, and the particle size is made smaller when driven into the hoop. Therefore, abrasive grains of oxide material exceeding a particle size of 25 μm, and abrasive grains of foreign matter of nitride and carbide exceeding the particle size of 17 μm may be used.

The manufacturing method for a hoop of the invention is based on the results of the studies above. That is, the present invention provides a manufacturing method for a hoop for a CVT belt, comprising barrel polishing using at least an abrasive material containing abrasive grains, the abrasive grains in the abrasive material comprising at least one of an oxide-type abrasive grain, a nitride-type abrasive grain, and a carbide-type abrasive grain, wherein the oxide-type abrasive grain has an average particle size of 30 μm or less, the nitride-type abrasive grain and the carbide-type abrasive grain have average particle sizes of 20 μm or less. By using the abrasive material containing such abrasive grains, the size of the foreign matter driven into the hoop can be limited in the specified range. Abrasive grains of nitride-type and carbide-type abrasive grains are not ground easily compared with oxide-type abrasive grains, and it is assumed that relatively large grains may be driven into the hoop after the barrel polishing process. From this point of view, too, it is important to define the particle size of nitride-type and carbide-type abrasive grains to be smaller than the particle size of oxide-type abrasive grains.

The inventors also researched into the particle size of grains contained in the media. According to the research made by the inventors, abrasive particles projecting from the media surface are often partially cut off and dissociated from the media during the barrel polishing process. Therefore, the abrasive grains contained in the media may be set to be larger than the abrasive grains contained in the abrasive material.

Another manufacturing method for a hoop of the invention is realized by quantitatively analyzing the particle size of abrasive grains dissociated from the media. That is, the present invention provides a manufacturing method for a hoop for a CVT belt, comprising barrel polishing using at least a media in which an abrasive grain is solidified by a binder, wherein the abrasive grain contained in the media has an average particle size of 100 μm or less. By using the media containing such abrasive grains, the size of the foreign matter driven into the hoop can be limited within the specified range.

In the manufacturing method of hoop of the invention, it is preferred to use the abrasive material and media together. The media is preferred to be composed of abrasive grains solidified by resin. That is, in barrel polishing, abrasive grains existing near the surface of the hoop are driven into the hoop by the impact of collision of the hoop and the media. Therefore, by using the binder made of resin, the impact of collision of media and hoop is lessened, and abrasive grains are hardly driven in. Moreover, by using the binder made of resin, the binding force of the abrasive grains and the binder is more resistant to impacts, and abrasive grains are hardly dissociated completely from the resin. Herein, the term "resin" refers to any binder mainly composed of synthetic resin or natural or synthetic rubber.

Generally, barrel polishing is a process of adding water and polishing by maintaining contact between the media and the hoop. Therefore, the polishing power in barrel polishing and the size of foreign matter driven into the hoop depend on the ratio by weight of the media to water (bulk specific gravity), rather than the weight of the media itself. When the bulk specific gravity of the media is close to that of water, the media behave similarly to flowing water, and the impact against the hoop is smaller, and the foreign matter to be driven is less, and in contrast, when the bulk specific gravity of the media is greater than that of water, the media tends to behave differently from flowing water, and the impact against the hoop is larger, and the foreign matter to be driven is estimated to be larger.

Therefore, the bulk specific gravity of the media is desired to be as small as possible. According to the research by the present inventors, it is known that the relationship between the bulk specific gravity and the particle size of the foreign matter driven into the hoop varies depending on whether the abrasive grains are oxide-type or carbide-type. That is, oxide-type abrasive grains are easily ground and are reduced in particle size, whereas carbide-type abrasive grains are difficult to grind, and therefore the bulk specific gravity of the media must be set to be smaller than in the case of oxide-type abrasive grains. From this point of view, when the media is composed of oxide-type abrasive grains, the bulk specific gravity of the media is preferred to be 2.0 or less, and in the case of the media composed of carbide-type abrasive grains, the bulk specific gravity of the media is preferred to be 1.6 or less.

It may be considered that relatively large abrasive grains may be dissociated from the media during the barrel polishing process, and if the barrel polishing process continues while such abrasive grains are present, they may be driven into the hoop, and the fatigue strength is lowered. Accordingly, after barrel polishing, at least by washing away the abrasive material, it is preferred to repeat such barrel polishing and washing several times. In this case of washing, only the abrasive material can be separated from the washing tank, or the abrasive material and media can be separated from the washing tank.

Materials for the hoop of the invention include, for example, maraging steel disclosed in JP-A No. 62-80322, and high strength stainless steel disclosed in JP-A No. 2000-63998.

DESCRIPTION OF THE PREFERRED EMBODIMENTS

Embodiment 1

The invention is more specifically described below by referring to the preferred embodiments.

Maraging steel in the composition shown in Table 1 (unit in wt. %) was used as the material. Inclusions in the material were extracted by a dissolving extraction method, and an electron microscope photograph of the inclusion of the maximum diameter obtained is shown FIG. 1. In the dissolving extraction method, the material was dissolved in methanol bromide and was filtered, and a nonmetallic inclusion was extracted from the residue. The composition of the nonmetallic inclusion was identified by qualitative analysis by an EDX (energy dispective X-ray analyzer). In the dissolving extraction method, aside from methanol bromide, it is also possible to use a mixed solution of nitric acid and hydrochloric acid, which may be selected appropriately depending on the material.

TABLE 1

| C | Si | Mn | P | S | Ni | Mo | Co | Al | Ti |
|---|---|---|---|---|---|---|---|---|---|
| ≦0.01 | ≦0.05 | ≦0.05 | ≦0.008 | ≦0.004 | 15–19 | 3–5.5 | 8–15 | 0.05–0.15 | 0.4–1.5 |

Figure 1A:
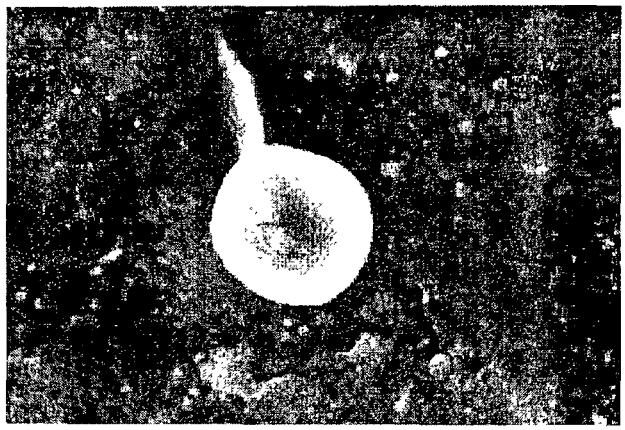
FIGS. 1A to 1C are illustrations/electron microscopy photographs showing inclusions in a material for a hoop in an embodiment of the invention.
Figure 1B:
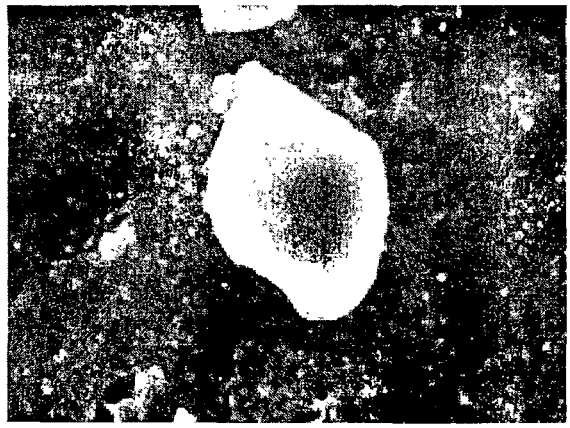
Figure 1C:
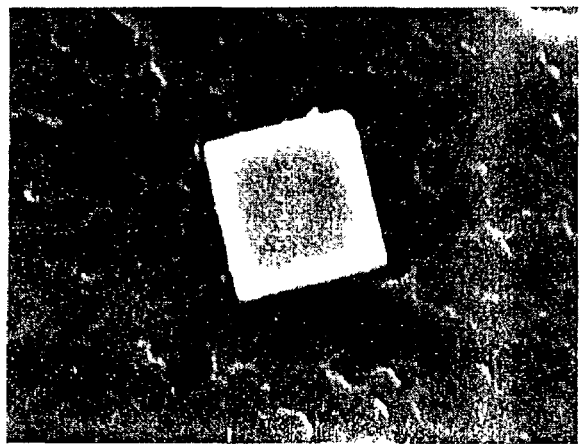

As shown in FIGS. 1A to 1C, the maximum particle size of $Al_2O_3$ was 8 μm, the maximum particle size of $SiO_2$ was 10 μm, and the maximum particle size of TiN was 10 μm. The particle size d of the nonmetallic inclusion was determined by the formula $d=(dx \times dy)^{0.5}$, where dx is the maximum crossing diameter, and dy is the maximum diameter in the direction orthogonal to the direction of the maximum crossing. In the following explanation, the term "particle size" always conforms to this definition.

Figure 2:
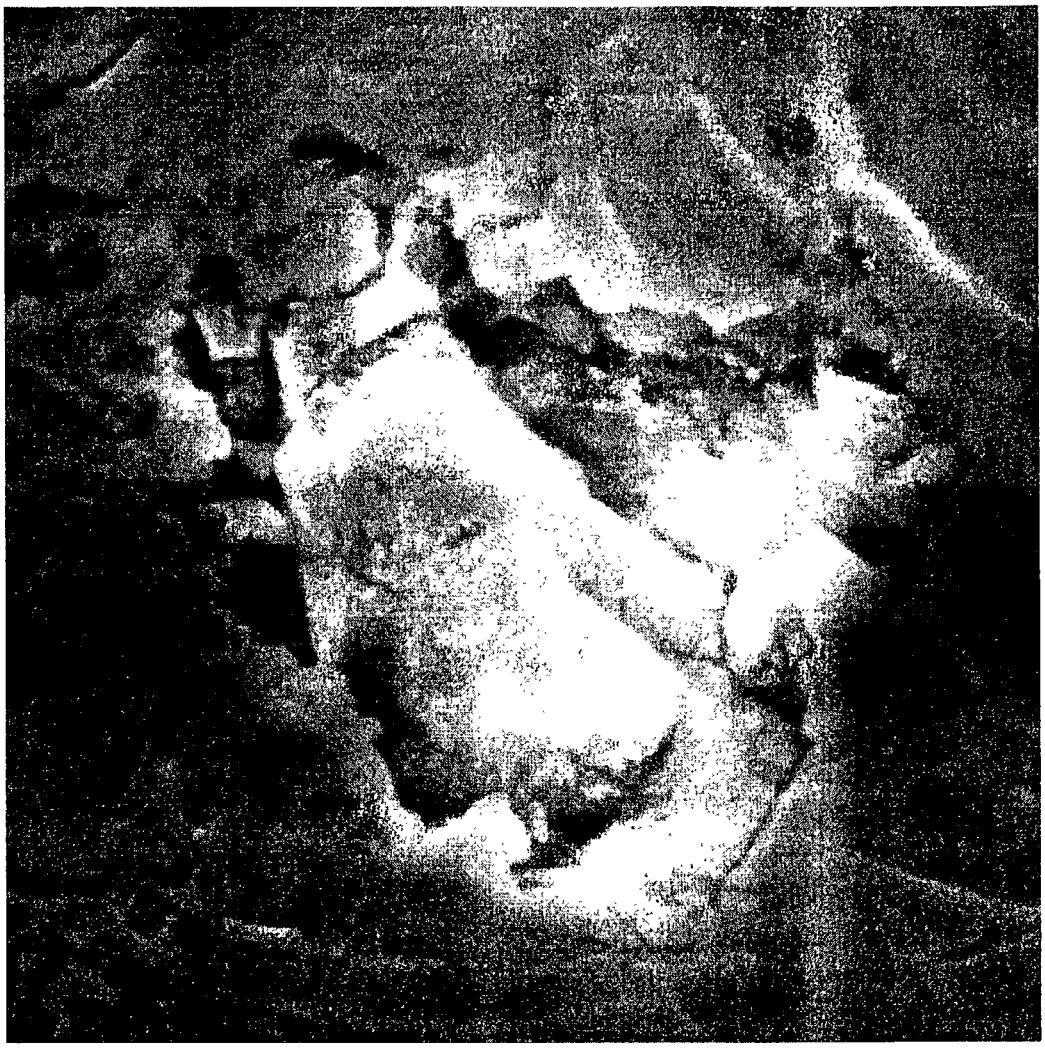
FIG. 2 is an illustration/electron microscopy photograph showing foreign matter existing on the surface of the hoop in an embodiment of the invention.

The material was processed into a hoop by a known method, and the marginal edges were removed by barrel polishing under various conditions. Other conditions of barrel polishing are shown in Table 2. A representative piece of foreign matter existing on the hoop surface is shown in an electron microscope photograph in FIG. 2. The foreign matter shown in FIG. 2 is considerably larger than the inclusions shown in FIGS. 1A to 1C, and this foreign matter was known to be an abrasive grain driven into the hoop by barrel polishing, not an inclusion precipitating in the material.

TABLE 2

| | Barrel method | Duration, number of times | Media: Abrasive grain | Media: Binder | Media: Shape | Media: Size | Media: Compound | Type of surface foreign matter | Foreign matter particle size (μm) |
|---|---|---|---|---|---|---|---|---|---|
| Sample 1 | Rotary barrel (24 rpm) | 4 hr continuous | $Al_2O_3$ Average particle size = 30 μm | Vitrified | Triangular prism | 15 × 12 mm | $Al_2O_3$ Average particle size = 30 μm | $Al_2O_3$ | 19 |

TABLE 2-continued

| | Barrel method | Duration, number of times | Media: Abrasive grain | Media: Binder | Media: Shape | Media: Size | Compound | Type of surface foreign matter | Foreign matter particle size (μm) |
|---|---|---|---|---|---|---|---|---|---|
| Sample 2 | | 4 hr continuous | $Al_2O_3$ Average particle size = 30 μm | Vitrified | Triangular prism | 15 × 12 mm | SiC Average particle size = 20 μm | SiC | 17<br>15<br>11<br>8 |
| Sample 3 | | 4 hr continuous | $Al_2O_3$ Average particle size = 30 μm | Vitrified | Triangular prism | 15 × 12 mm | TiN Average particle size = 20 μm | TiN | 10<br>15 |
| Sample 4 | | 1 hr × 4 times | $Al_2O_3$ Average particle size = 100 μm | Vitrified | Triangular prism | 15 × 12 mm | None | $Al_2O_3$ | 23 |
| Sample 5 | | 4 hr continuous | $ZrO_2$ Average particle size = 100 μm | Resin | Triangular pyramid | 15 × 12 mm | None | $ZrO_2$ | 25<br>22<br>17.3<br>11.5<br>8.8<br>7.3 |
| Sample 6 | | 4 hr continuous | $Al_2O_3$ Average particle size = 50 μm | Vitrified | Triangular prism | 15 × 12 mm | $Al_2O_3$ Average particle size = 50 μm | $Al_2O_3$ | 37<br>31 |
| Sample 7 | | 4 hr continuous | $Al_2O_3$ Average particle size = 100 μm | Vitrified | Triangular prism | 15 × 12 mm | None | $Al_2O_3$ | 33 |
| Sample 8 | | 4 hr continuous | $Al_2O_3$ Average particle size = 30 μm | Vitrified | Triangular prism | 15 × 12 mm | SiC Average particle size = 40 μm | SiC | 50<br>25<br>25 |
| Sample 9 | | 4 hr continuous | $Al_2O_3$ Average particle size = 30 μm | Vitrified | Triangular prism | 15 × 12 mm | TiN Average particle size = 30 μm | TiN | 22<br>43 |
| Sample 10 | | 4 hr continuous | $Al_2O_3$ Average particle size = 100 μm | Vitrified | Triangular prism | 15 × 12 mm | None | $ZrO_2$ | 30 |

Figure 5:
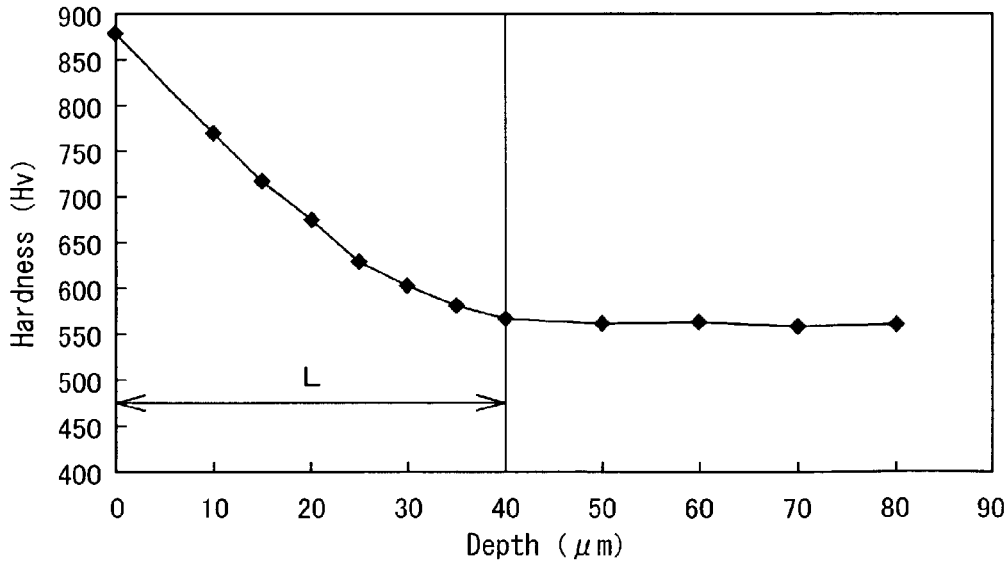
FIG. 5 is a graph showing the relationship between depth from surface and hardness of the hoop in an embodiment of the invention.
Figure 6:
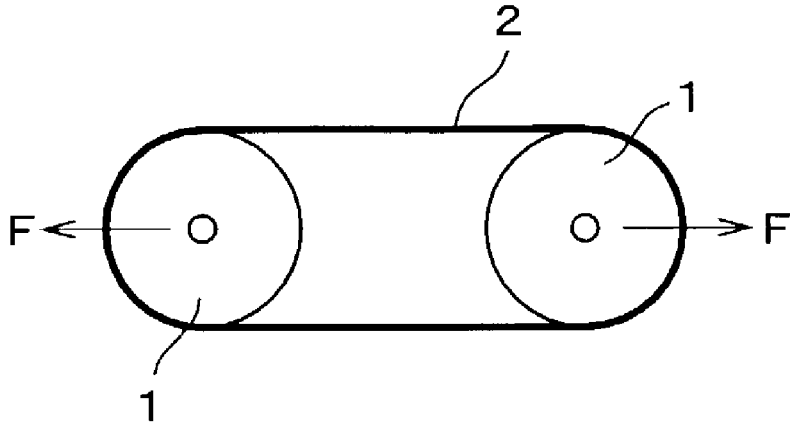
FIG. 6 is a side view showing a machine for testing fatigue in an embodiment of the invention.

The hoop sample was aged and was nitrided in an atmosphere containing ammonia gas. The hoop thus fabricated measured 9 mm in width, 0.18 mm in thickness, and 600 mm in peripheral length, having a hardness distribution in the depth direction shown in FIG. 5. In FIG. 5, the region indicated by symbol L is a layer hardened by nitriding. In order to investigate the flexural fatigue characteristic of these hoops, a fatigue test was conducted by using a testing machine shown in FIG. 6. The testing machine shown in FIG. 6 is designed to wind a hoop 2 around a pair of rollers 1 and 1 of 55 mm in diameter, and to rotate while applying a force to the rollers 1 and 1 in directions to differing from each other. In the fatigue test, the force applied to the rollers 1 and 1 was 3200 N. In this fatigue test, in every revolution of the hoop 2, two bending forces are applied by the rollers 1, and hence two times of the number of revolutions of the hoop 2 is defined as the service life (number of cycles). The fatigue test was terminated when the hoop 2 broke or the service life reached $10^8$ cycles.

Figure 3:
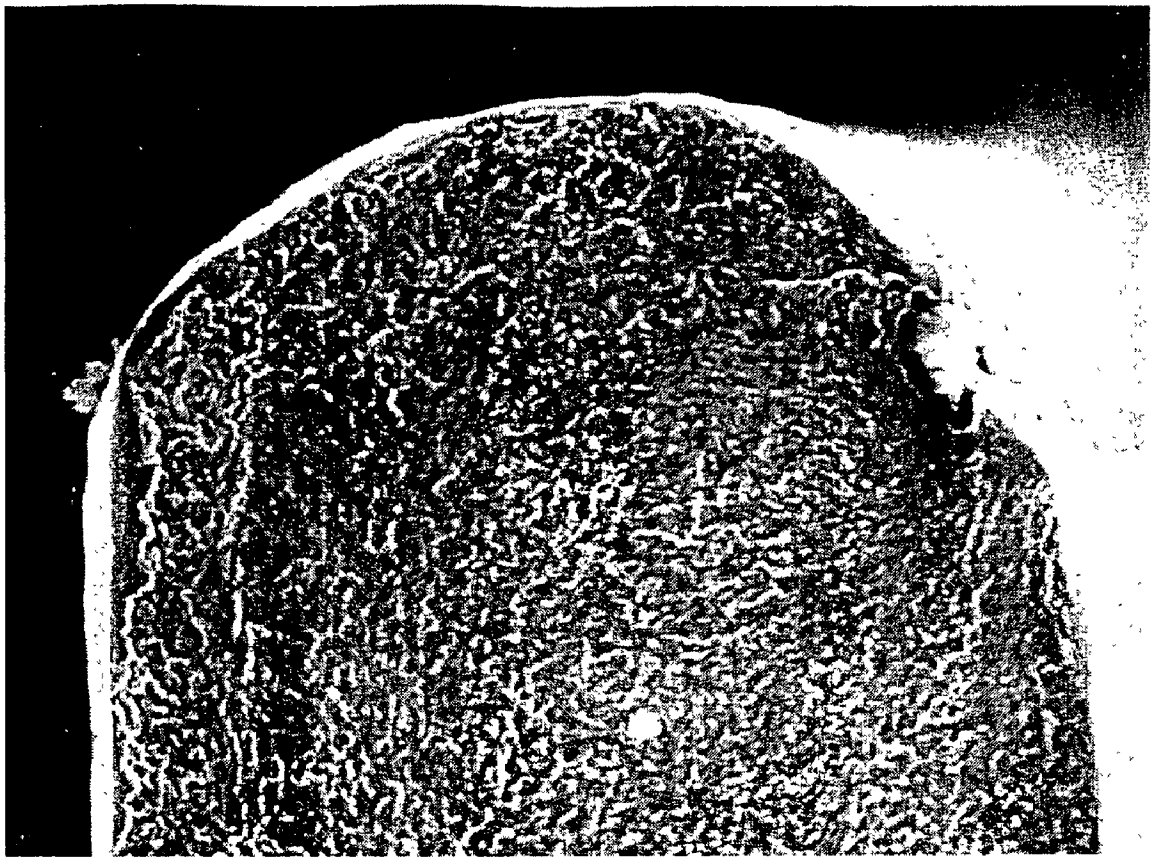
FIG. 3 is an illustration/electron microscopy photograph showing foreign matter opposite to the rupture plane on the surface of the hoop in an embodiment of the invention.
Figure 4:
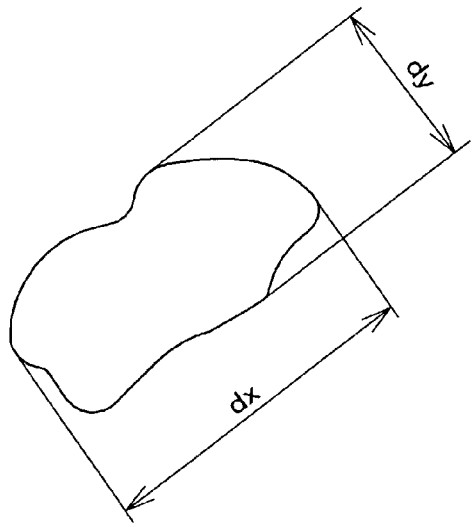
FIG. 4 is a drawing of foreign matter for explaining the definition of particle size in the invention.
Figure 7:
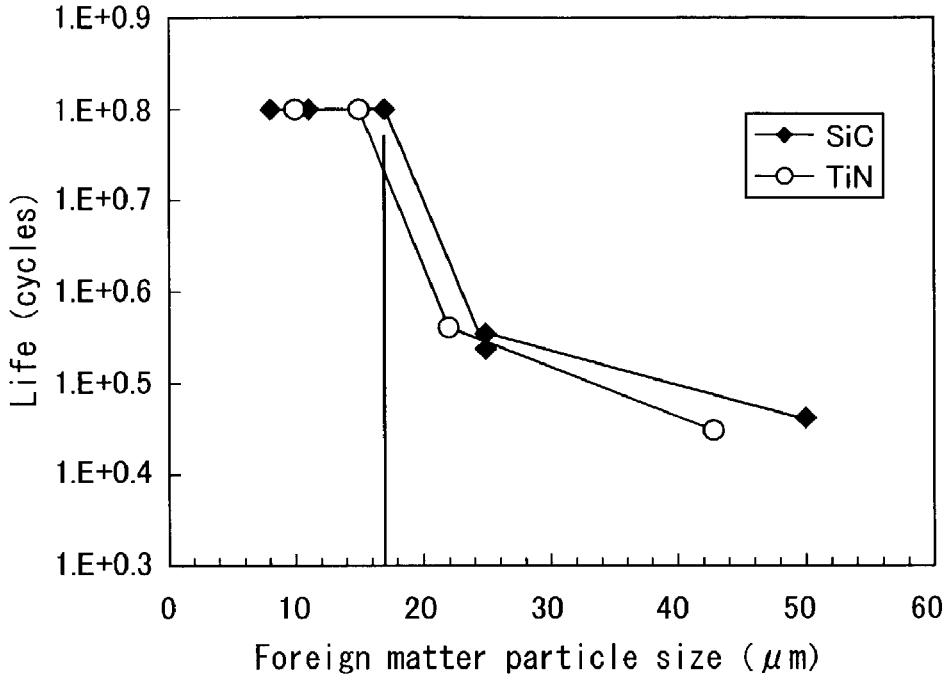
FIG. 7 is a graph showing the relationship between the particle size of foreign matter and service life in nitrides and carbides in an embodiment of the invention.
Figure 8:
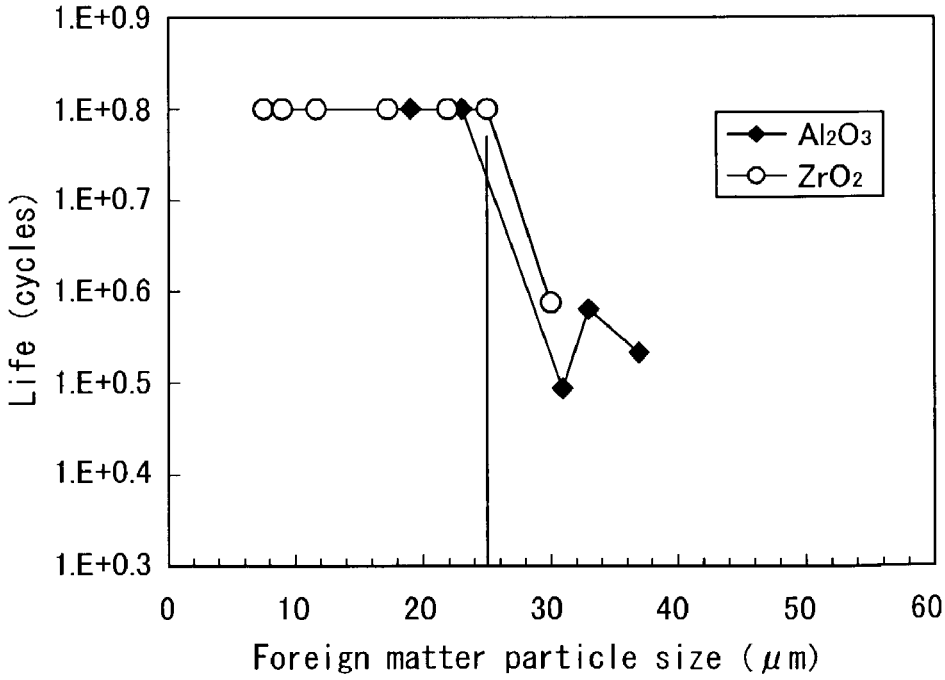
FIG. 8 is a graph showing the relationship between the particle size of foreign matter and service life in oxides in an embodiment of the invention.

FIG. 3 shows an electron microscope photograph of fracture surface of the hoop. As shown in FIG. 3, since the foreign matter driven into the hoop surface is opposite to the fracture surface, it is known that the foreign matter is the initiation of the fracture. The particle size of the foreign matter on the hoop surface opposite to the fracture surface is also shown in Table 2. In the hoop does not rupture in $10^8$ cycles, the maximum particle size of the foreign matter on the surface extracted by the dissolving extraction method is mentioned in Table 2. FIG. 7 shows the relationship between the particle size and life of the foreign matter of nitride or carbide, and FIG. 8 shows the relationship between the particle size and life of the foreign matter of oxide. It is known from FIG. 7 and FIG. 8 that the life is generally close to $10^8$ cycles when the particle size of foreign matter existing on the hoop surface is 25 μm or less. In particular, as shown in FIG. 7, when the foreign matter is nitride and carbide, the life is $10^8$ cycles at the particle size of 17 μm or less, and extremely excellent fatigue strength is demonstrated. Alternatively, as shown in FIG. 8, when the foreign matter is oxide, the life is $10^8$ cycles at the particle size of 25 μm or less, and extremely excellent fatigue strength is demonstrated. From these results, it is known that there is a difference in the hydrogen capturing amount between oxide foreign matter and nitride or carbide foreign matter, and also that the susceptibility to fatigue and allowable particle size of foreign matter are different. As for limitation of particle size by the type of foreign matter, the range of the invention is confirmed to be appropriate.

The barrel polishing conditions are discussed. As is known from Table 2, by barrel polishing by using media and compound, abrasive grains of the compound are driven into the hoop (samples 2, 3, 8, 9). In the case of barrel polishing by the media alone, abrasive grains of the media are driven into the hoop (samples 4, 5, 7, 10). In any case, the particle size of abrasive grains driven into the hoop is smaller than the particle size of the abrasive grains, and it is less than 25 μm of the upper limit of the invention in samples 1 to 5. This is because the abrasive grains are ground along with the progress in barrel polishing.

In sample 1 of particle size of oxide abrasive grains contained in the compound of 30 μm or less, the particle size of foreign matter driven into the hoop is 19 μm, which is substantially smaller than the preferable range of 25 μm for the invention. In contrast, in sample 6 of particle size of oxide abrasive grains contained in the compound exceeding 30 μm, the particle size of the foreign matter driven into the hoop is 37 μm.

In samples 2 and 3 of particle size of nitride or carbide abrasive grains contained in the compound of 20 μm or less, the particle size of foreign matter driven into the hoop is 17 μm or less, which is smaller than the preferable range of 17 μm or less for the invention. In contrast, in samples 8 and 9 of particle size of nitride or carbide abrasive grains contained in the compound exceeding 20 μm, the particle size of the foreign matter driven into the hoop is 22 μm or more.

In sample 5 (using media only) of which the binder of media is a resin, although the average particle size of the abrasive grains of the media is 100 μm, the particle size of foreign matter driven into the hoop is 7.3 to 25 μm. That is, in sample 5, since the weight of the media is low, the impact is small and drop-out of abrasive grains is less, and hence the collision impact between the media and hoop is smaller, so that the abrasive grains to be driven are smaller in size. On the other hand, in sample 7, since the binder is vitrified, the weight of the media is greater than that of the resin, and the impact is larger. As a result, the particle size of foreign matter was as large as 33 μm, and hence the life was only $10^6$ cycles (see FIG. 8).

In samples 8 and 9, foreign matter of a larger particle size than the particle size of abrasive grains of the compound being used was detected. Accordingly, inclusions of the material of samples 8 and 9 were measured by a dissolving extraction method, and larger inclusions than abrasive grains were observed. That is, the abrasive grains contain some larger than average particle size. In the case of alumina or other oxide abrasive grains, they are ground right after the start of grinding, and become smaller than the average particle size, but since abrasive grains of nitride and carbide are less likely to be ground, abrasive grains larger than the average particle size are left over, which are finally driven into the hoop surface.

Embodiment 2

Figure 9:
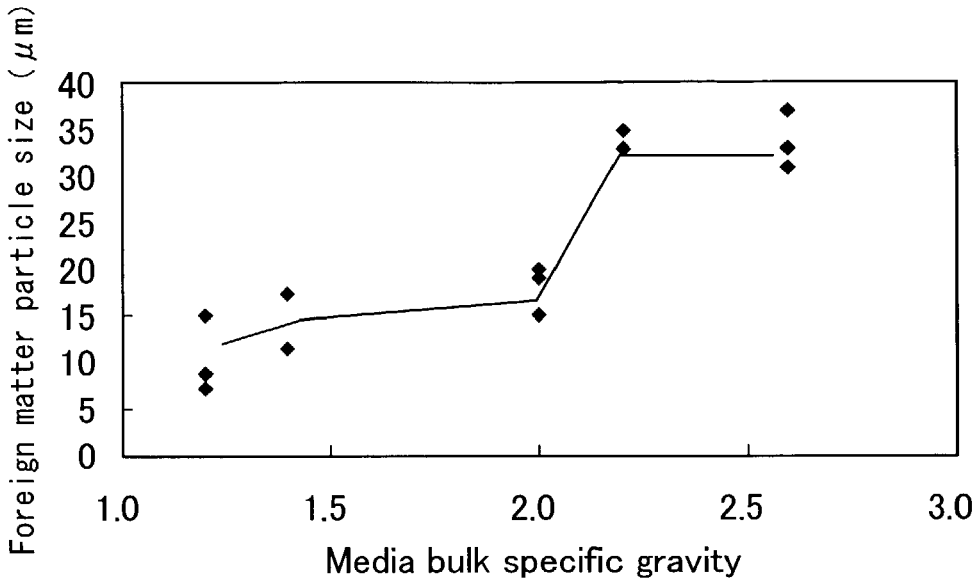
FIG. 9 is a graph showing the relationship between the bulk specific gravity of the media and maximum particle size of the foreign matter of oxide abrasive grains in an embodiment of the invention.

The bulk specific gravity of the media is discussed. Hoops were fabricated in the same conditions as in Embodiment 1, and marginal edges were removed by barrel polishing under various conditions. In this barrel polishing, using the resin having oxide abrasive grains bound by a binder, various bulk specific gravities were set by varying the abrasive grain rate of the media (the content of abrasive grains in the media). In this barrel polishing, the rotary barrel was set at a speed of 24 rpm, and polishing was operated continuously for 4 hours. Table 3 shows other conditions of barrel polishing. The maximum particle size of foreign matter extracted from the surface of the hoop after barrel polishing by the dissolving extraction method is also recorded in Table 3, and the relationship between the bulk specific gravity of the media and the maximum particle size of the foreign matter driven into the hoop is shown in FIG. 9. As is known from FIG. 9, in the case of oxide abrasive grains, when the bulk specific gravity of the media is 2.0 or less, the maximum particle size of the foreign matter is 20 μm or less, which is within a preferred range of 25 μm or less of the invention.

TABLE 3

| Media | | | | Bulk specific | | Type of foreign | Particle size of |
|---|---|---|---|---|---|---|---|
| Abrasive grain | Binder | Shape | Size | gravity ($g/cm^3$) | Compound | matter on surface | foreign matter (μm) |
| $ZrO_2$ Average particle size = 100 μm | Resin | Triangular pyramid | 15 × 12 mm | 1.2 | None | $ZrO_2$ | 7.3 |
| | | | | 1.2 | | | 15 |
| | | | | 1.2 | | | 8.8 |
| | | Triangular pyramid | 15 × 12 mm | 1.4 | | | 17.3 |
| | | | | 1.4 | | | 11.5 |
| | | Triangular pyramid | 15 × 12 mm | 2 | | | 15 |
| | | | | 2 | | | 20 |
| | | | | 2 | | | 19 |
| $ZrO_2$ Average particle size = 100 μm | Resin | Triangular pyramid | 15 × 12 mm | 2.2 | None | $ZrO_2$ | 35 |
| | | | | 2.2 | | | 33 |

TABLE 3-continued

| Media | | | | Bulk specific | | Type of foreign | Particle size of |
|---|---|---|---|---|---|---|---|
| Abrasive grain | Binder | Shape | Size | gravity ($g/cm^3$) | Compound | matter on surface | foreign matter (μm) |
| $Al_2O_3$ | Vitrified | Triangular | 15 × 12 | 2.6 | None | $Al_2O_3$ | 37 |
| Average | | prism | mm | 2.6 | | | 33 |
| particle | | | | 2.6 | | | 31 |
| size = 100 | | | | | | | |
| μm | | | | | | | |

Figure 10:
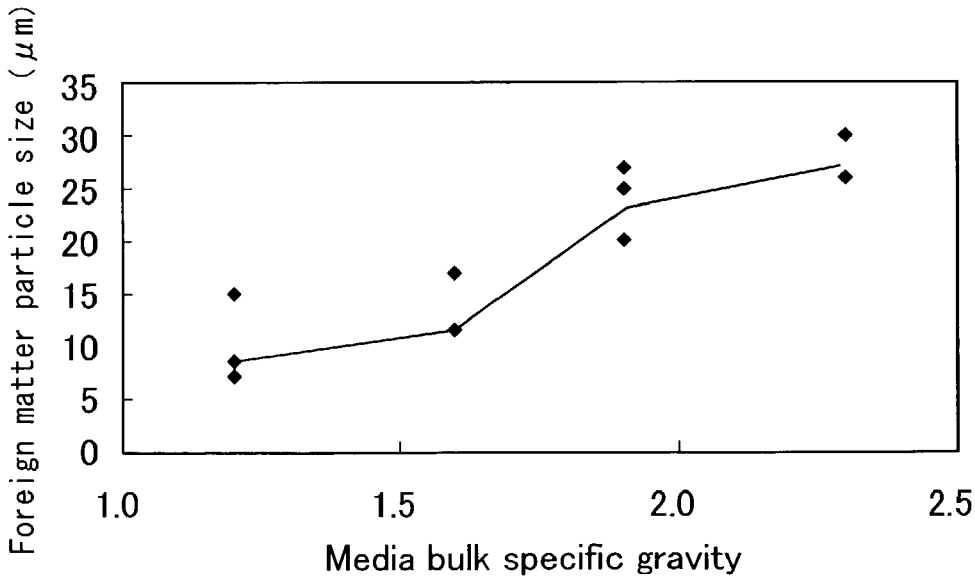
FIG. 10 is a graph showing the relationship between the bulk specific gravity of the media and maximum particle size of the foreign matter of carbide abrasive grains in an embodiment of the invention.

In addition, using the resin having carbide abrasive grains bound by a binder, various bulk specific gravities were set by varying the abrasive grain rate of the media. Under the same conditions as above, the hoop was processed by barrel polishing. Table 4 shows other conditions of barrel polishing. The maximum particle size of foreign matter extracted from the surface of the hoop after barrel polishing by the dissolving extraction method is also recorded in Table 4, and the relationship between the bulk specific gravity of the media and the maximum particle size of the foreign matter driven into the hoop is shown in FIG. 10. As is known from FIG. 10, in the case of carbide abrasive grains, when the bulk specific gravity of the media is 1.7 or less, the maximum particle size of the foreign matter is 17 μm or less, which is within a preferred range of 17 μm or less of the invention.

TABLE 4

| Media | | | | Bulk specific | | Type of foreign | Particle size of |
|---|---|---|---|---|---|---|---|
| Abrasive grain | Binder | Shape | Size | gravity ($g/cm^3$) | Compound | matter on surface | foreign matter (μm) |
| SiC | Resin | Triangular | 15 × 12 | 1.2 | None | SiC | 7.3 |
| Average | | pyramid | mm | 1.2 | | | 15 |
| particle | | | | 1.2 | | | 8.8 |
| size = 100 | | Triangular | 15 × 12 | 1.6 | | | 17 |
| μm | | pyramid | mm | 1.6 | | | 11.5 |
| SiC | Resin | Triangular | 15 × 12 | 1.9 | None | SiC | 27 |
| Average | | pyramid | mm | 1.9 | | | 20 |
| particle | | | | 1.9 | | | 25 |
| size = 100 | | Triangular | 15 × 12 | 2.3 | | | 30 |
| μm | | pyramid | mm | 2.3 | | | 26 |

What is claimed is:

1. A hoop for a CVT belt, the hoop made from a maraging steel comprising:

a hardened layer formed from a surface of the hoop to inside by nitriding;

abrasive grains embedded into the surface of the hoop from outside the hoop and exposed on the surface of the hoop due to barrel polishing using an abrasive material including abrasive grains, wherein the hoop was aged and nitrided in an atmosphere containing ammonia gas, and wherein a clearance is formed between the abrasive grain and a matrix of the hoop, and the abrasive grains have a particle size of 25 μm or less.

2. The hoop for a CVT belt according to claim 1, wherein the abrasive grains comprises at least one of an oxide abrasive grains, a nitride abrasive grains, and a carbide abrasive grains, the oxide abrasive grains have a particle size of 25 μm or less, the nitride abrasive grains and the carbide abrasive grains have particle sizes of 17 μm or less.

3. The hoop for a CVT belt according to claim 1, wherein the abrasive grains have a particle size of from 7.3 to 25 μm.

4. The hoop for a CVT belt according to claim 1, wherein the clearance formed between the abrasive grain and the matrix of the hoop is one of either a groove and a recess.

5. The hoop for a CVT belt according to claim 2, wherein the oxide abrasive grains are at least one of $Al_2O_3$, $SiO_2$, and $ZrO_2$, and the nitride abrasive grains and carbide abrasive grains are TiN and SiC.

* * * * *